US008167666B2

(12) United States Patent
Koga et al.

(10) Patent No.: US 8,167,666 B2
(45) Date of Patent: May 1, 2012

(54) TERMINAL CRIMPING METHOD, TERMINAL CRIMPING STRUCTURE, TERMINAL CRIMPING DEVICE, AND ELECTRICAL CONNECTOR

(75) Inventors: Jun Koga, Kanagawa (JP); Ryuichi Komiyama, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 9 days.

(21) Appl. No.: 12/524,407

(22) PCT Filed: Dec. 19, 2007

(86) PCT No.: PCT/JP2007/074374
§ 371 (c)(1),
(2), (4) Date: Mar. 29, 2010

(87) PCT Pub. No.: WO2008/090693

PCT Pub. Date: Jul. 31, 2008

(65) Prior Publication Data

US 2011/0136397 A1 Jun. 9, 2011

(30) Foreign Application Priority Data

Jan. 25, 2007 (JP) ..... 2007-015539

(51) Int. Cl.
*H01R 11/22* (2006.01)

(52) U.S. Cl. ..... 439/852; 439/595

(58) Field of Classification Search ..... 439/595, 439/884–885, 852
See application file for complete search history.

(56) References Cited

U.S. PATENT DOCUMENTS

| | | | | |
|---|---|---|---|---|
| 6,869,312 | B2 * | 3/2005 | Hasebe | 439/595 |
| 6,905,376 | B2 * | 6/2005 | Chen | 439/852 |
| 7,229,328 | B2 * | 6/2007 | Sawada et al. | 439/852 |
| 7,470,159 | B2 * | 12/2008 | Hara | 439/852 |
| 7,488,211 | B2 * | 2/2009 | Yamaoka | 439/595 |
| 7,497,721 | B2 * | 3/2009 | Lauermann et al. | 439/441 |
| 7,513,792 | B2 * | 4/2009 | Kumakura | 439/422 |

FOREIGN PATENT DOCUMENTS

| | | |
|---|---|---|
| JP | 07-14658 | 1/1995 |
| JP | 714658 | 1/1995 |
| JP | 09-306555 | 11/1997 |
| JP | 9306555 | 11/1997 |
| JP | 2001-143807 A | 5/2001 |
| JP | P2001143807 A | 5/2001 |

OTHER PUBLICATIONS

International Preliminary Report for PCT/JP2007/074374 issued Aug. 6, 2009, (5 pages).
PCT WO 2008/090693 A1 Search Report dated Jul. 31, 2008, 28 pages.

* cited by examiner

*Primary Examiner* — Truc Nguyen
(74) *Attorney, Agent, or Firm* — Barley Snyder

(57) ABSTRACT

A terminal crimping method and a crimping tool are provided, thereby suppressing the generation of friction at an anvil and a crimper and also suppressing the generation of an upthrust portion at the upper part of a wire barrel to which a conductor of a covered electrical wire is crimped. The crimping tool includes an anvil having a placement groove on which a female-type terminal is mounted, and a crimper that crimps a conductor barrel of the female-type terminal mounted on the anvil. The placement groove includes a first pressing portion that presses the effective crimping portion and a second pressing portion that presses the extension, and the bottom surface of the second pressing portion is formed as an inclined surface expanding and opening toward a receptacle side.

3 Claims, 8 Drawing Sheets

TERMINAL CRIMPING METHOD, TERMINAL CRIMPING STRUCTURE, TERMINAL CRIMPING DEVICE, AND ELECTRICAL CONNECTOR

CROSS-REFERENCE TO RELATED APPLICATIONS

This application is a national stage filing of PCT International Application No. PCT/JP2007/074374, filed Dec. 19, 2007, which claims priority under 35 U.S.C. §119 to Japanese Patent Application No. JP 2007-015539, filed Jan. 25, 2007.

FIELD OF THE INVENTION

The present invention relates to a terminal crimping method, terminal crimping structure, crimping tool, and electrical connector having the terminal crimping structure, whereby a terminal which includes a conductor barrel for crimping a conductor of a covered electrical wire and cover an end portion of the conductor.

BACKGROUND

A conventional electrical connector, as shown in FIGS. 5 and 6, are known from Japanese Patent No. JP 2001-143807 A.

FIG. 5 is a partially cutaway cross-sectional view showing a waterproof connector, while FIG. 6 is a partially cutaway cross-sectional view showing a terminal, which is being inserted into a cavity of the waterproof connector shown in FIG. 5.

A waterproof connector 100, shown in FIGS. 5 and 6, includes multiple terminals 110 (however, only one terminal is shown in FIGS. 5 and 6) and a connector housing 120 in which the terminals 110 are accommodated.

Each terminal 110 includes a receptacle 111 and a conductor grip 112, and is formed by stamping and forming a metal plate.

The receptacle 111 is configured to have a substantial box shape to receive a tab provided at the mating connector (not shown). The receptacle 111 includes a base plate 113 that extends in the front-rear direction (the horizontal direction of FIG. 5), a pair of side walls 114 that stand up from both side edges in the widthwise direction (the direction perpendicular to the sheet face of FIG. 5) of the base plate 113, and an upper plate 115 that is bent from one of the pair of side walls 114.

The conductor grip 112 includes: a conductor barrel 116, which extends from the rear end of the base plate 113 and which crimps a conductor S of an covered electrical wire W, and an insulation grip 117, which extends from the rear end of the conductor barrel 116 and which crimps an insulation portion H of the covered electrical wire W.

In this situation, in order to ensure electrical and mechanical connections, the conductor barrel 116 should be crimped to the conductor S over the entire length in its inserting/extracting direction (the horizontal direction of FIG. 5). Hence, the conductor S of the covered electrical wire W is crimped to the conductor barrel 116 with its end T protruding frontward from the conductor barrel 116.

The connector housing 120 is provided with multiple cavities 121 in two stages, namely upper and lower stages, into which the terminals 110 are accommodated, respectively.

On the rear side of multiple cavities 121 in the connector housing 120, there is provided a sealing member fitting portion 123 into which a sealing member 122 is fit and inserted.

The sealing member 122 is provided with multiple through-holes 124 that align with the cavities 121, respectively. In addition, three ribs 125 are arranged at the inner circumferential surface in each of the through-holes 124.

Then, in the waterproof connector 100 as shown in FIG. 6, each terminal 110 is inserted into each cavity 121 from each through-hole 124 in the sealing member 122. This allows the respective ribs 125 of the sealing member 122 to be tight around the covered electrical wire W of the terminal 110 that has been inserted into the through-hole 124, thereby preventing any water from entering the interior of the cavity 121 from the extracting side of the covered electrical wire W.

It should be noted, however, that in the terminal 110 of the waterproof connector 100, the end T of the conductor protrudes frontward to be exposed from the conductor barrel 116. Accordingly, in a case where the end T of the conductor S of the covered electrical wire W protrudes frontward to be exposed from the conductor barrel 116, there is a problem that the end T will damage the sealing member 122 when the terminal 110 is inserted into the through-hole 124 of the sealing member 122. Then, if the sealing member 122 is damaged, tightness between the sealing member 122 and the covered electrical wire W will be compromised. This will degrade the waterproof property in the cavity 121, when the waterproof connector 100 mates with the mating connector.

Therefore, a terminal shown in FIG. 7 has been proposed to address the above problem.

FIG. 7 is a perspective view showing a terminal in which an end portion of a core wire is protected.

A terminal 130, in which an end of a conductor is protected, as shown in FIG. 7, basically has the same configuration as that of the terminal 110, and is formed by stamping and forming a metal plate. However, a retainer catch 137, to be locked by a retainer (not shown) when the terminal 130 is included in an electrical connector (not shown), is provided at the upper surface of a receptacle 136 of the terminal 130.

Also, a conductor barrel 131 of the terminal 130 is provided with a crimping portion 132 that crimps the conductor of the covered electrical wire W (not shown in FIG. 7), and an extension 133 that covers the end of the conductor S of the covered electrical wire W.

The extension 133 is arranged on the front side of the crimping portion 132. The extension 133 is provided with a confirmation hole 134.

The confirmation hole 134 is provided for confirming the position of the end of the conductor in the conductor barrel 131 with the conductor of the covered electrical wire W crimped to the conductor barrel 131.

Additionally, in the terminal 130, the crimping portion 132 of the conductor barrel 131 crimps the conductor of the covered electrical wire W, and at the same time, the extension 133 covers the end portion of the conductor. In this manner, the extension 133 covers the end of the conductor of the covered electrical wire W, thereby preventing the end of the conductor from protruding frontward to be exposed from the conductor barrel 131.

Accordingly, with the terminal 130, it is possible to prevent the end of the conductor from damaging the sealing member 122, when the terminal 130 is inserted into the sealing member provided in the connector housing 120 shown in FIG. 5.

Moreover, after the crimping of the conductor of the covered electrical wire W to the conductor barrel 131 is completed, the position of the end of the conductor in the conductor barrel 131 is confirmed from the confirmation hole 134 of the extension 133. This makes it possible to confirm whether or not the conductor is crimped over the entire length in the inserting/extracting direction of the crimping portion 132 (the direction from the left near side to the right far side of FIG. 7).

In this case, the conductor of the covered electrical wire W is crimped to the conductor barrel 131, by pressing the conductor barrel 131 with an anvil and a crimper to swage the conductor barrel 131 in which the conductor is arranged.

Meanwhile, the length of the conductor barrel 131 in the front-rear direction (the direction from the left near side to the right far side of FIG. 7) in the terminal 130 is longer than the conductor barrel 116 in the terminal 110 shown in FIG. 6 by only the provision of the extension 133 in its length. If the conductor barrel 131 is longer, a greater pressing force is needed for swaging the conductor barrel 131 when the conductor of the covered electric wire W is crimped. Next, if the pressing force exerted from the anvil and the crimper to the conductor barrel 131 is greater, a reaction force exerted from the conductor barrel 131 to the anvil and the crimper will be greater when the conductor of the covered electric wire W is crimped. Then, if the reaction force exerted on the anvil and the crimper is greater when the conductor of the covered electric wire W is crimped, there is a problem that abrasion will be caused at the anvil and the crimper.

Hence, in order to address the above problem, the conductor of the covered electrical wire W is crimped to the conductor barrel 131 by a crimping tool 140 shown in FIG. 8.

FIG. 8 is a partial cross-sectional view showing the relationship between a conductor barrel of a terminal, and an anvil and a crimper included in the crimping tool. FIG. 8 shows a state where the crimping of the conductor of the covered electrical wire W to the conductor barrel 131 is completed.

That is to say, as shown in FIG. 8, the crimping tool 140 is provided with an anvil 141 that supports the conductor barrel 131 from the bottom side, and a crimper 142 that presses the conductor barrel 131 from the top side.

The lower surface of the crimper 142 has a pressing surface 143 that presses the conductor barrel 131. As shown in FIG. 8, the pressing surface 143 of the crimper 142 has a portion for pressing the extension 133, which is formed as an inclined surface 144 expanding and opening frontward.

When the conductor of the covered electrical wire (not shown in FIG. 8) is crimped to the conductor barrel 131 by the crimping tool 140, the extension 133 of the conductor barrel 131 is deformed along the inclined surface 144 of the pressing surface 143 in the crimper 142 and then an upthrust portion 145 is formed.

Thus, in the crimping tool 140, the conductor of the covered electrical wire W is crimped only to the crimping portion 132 in the conductor barrel 131, whereas the conductor is not crimped to the extension 133 because the upthrust portion 145 is formed. Accordingly, with the use of the crimping tool 140, the pressing force needed for crimping the conductor of the electric wire W to the conductor barrel 131 can be suppressed, so the reaction force exerted from the conductor barrel 131 to the anvil 141 and the crimper 142 can be suppressed.

Therefore, the crimping tool 140 is capable of suppressing abrasion caused at the anvil 141 and the crimper 142.

In this sense, when the terminal 130 is included in an electrical connector, the terminal 130 is secondarily locked by a retainer (not shown) to prevent the terminal 130 from dislodging from a connector housing (not shown). In such a case, the retainer is disposed above the conductor barrel 131 of the terminal 130, so the front surface of a locking portion (not shown) provided at the retainer locks the rear surface of the retainer catch 137 of the terminal 130, whereby the rearward movement of the terminal 130 is prevented.

Meanwhile, in recent years, there has been an increasing need for downsizing the electrical connector and increasing the number of terminals. In order to downsize the electrical connector and increase the number of terminals, it is necessary to narrow the arrangement pitch between the terminals included in the electrical connector.

However, if the terminal 130, in which the conductor of the covered electrical wire is crimped to the conductor barrel 131 by the crimping tool 140, is applied to an electrical connector in which the arrangement pitch between the terminals is narrow, the upthrust portion 145 will interfere with the retainer. Next, if the upthrust portion 145 interferes with the retainer, the retainer cannot be pushed to a predetermined position of the housing, resulting in an insufficient lock by means of the retainer for locking the retainer catch 137 in the terminal 130. Then, if the lock between the retainer and the retainer catch 137 of the terminal 130 is insufficient, there is a problem that a desired retaining force of the terminal 130 will not be obtainable by means of the retainer.

Meanwhile, when the terminal 130 is locked by the retainer, the terminal 130 is inserted into the housing with the terminal 130 disposed at a temporary locking position, firstly. In this case, the retainer is located above the conductor barrel 131 of the core-wire end-portion protected terminal 130 (at the upper side of FIG. 8). Subsequently, the retainer at the temporary locking position is made to slide downward (to the lower side of FIG. 8) to be disposed at a proper locking position. In this case, the front surface of a engaging portion in the retainer locks the rear surface of the retainer catch 137 of the terminal 130 to prevent the terminal 130 from moving rearward. Accordingly, in the sate where the retainer is located at the proper locking position, a space that corresponds to a sliding amount of the retainer that has been made to slide from the temporary locking position to the proper locking position is inevitably created below the conductor barrel 131 of the terminal 130.

SUMMARY

The present invention has been made in view of the above problem, and has an object to provide a terminal crimping method and a crimping tool, thereby suppressing the generation of abrasion at an anvil and a crimper, and simultaneously preventing the formation of an upthrust portion at the upper part of a wire barrel to which a conductor of an covered electrical wire is crimped.

A terminal crimping structure is provided including a terminal having a receptacle, a conductor barrel that opens upward, a crimping portion and an extension. The receptacle includes a retainer catch that protrudes upward. The crimping portion is adapted to crimp the conductor of the covered electrical wire, and the extension is positioned at a front of the crimping portion and located to cover an end portion of a conductor of a covered electrical wire when the conductor is crimped. The terminal is mounted on a placement groove where the conductor is crimped to the conductor barrel by pressing the conductor barrel using a crimper. The placement groove includes a first pressing portion that presses the crimping portion and a second pressing portion that presses the extension. A bottom surface second pressing portion is formed as an inclined surface expanding and opening toward the receptacle side, so an inclined base portion is formed at a lower part of the extension.

BRIEF DESCRIPTION OF THE DRAWINGS

The invention will be explained in greater detail in the following with reference to embodiments, referring to the appended drawings, in which.

DETAILED DESCRIPTION OF THE EMBODIMENT(S)

The invention will now be described in greater detail. Reference will now be made in detail to the embodiments of the present invention, which are illustrated in the accompanying drawings, FIGS. 1 through 4. Incidentally, in FIG. 3, the covered electrical wire that is crimped to the terminal is omitted. Also, in FIG. 4, the conductor that is crimped to the wire barrel is omitted.

A terminal crimping structure 1 according to an exemplary embodiment of the present invention is applicable to a terminal or the like included in an electrical connector. In addition, the terminal crimping structure 1 is applicable to any male terminal or female terminal.

According to the exemplary embodiment shown, a description will be given of a case where the terminal crimping structure 1 is applied to the female terminal for use in the electrical connector.

Figure 1:
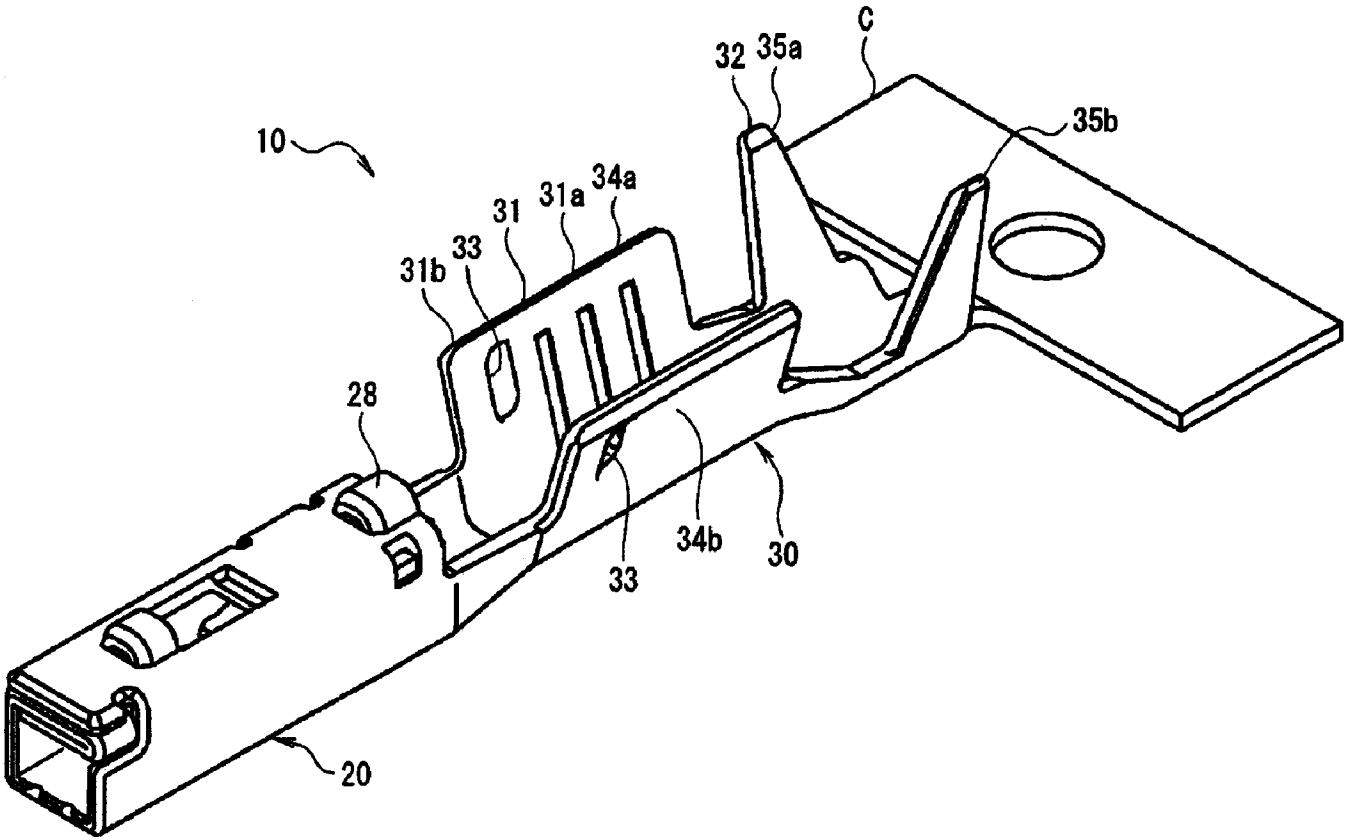
FIG. 1 is a perspective view of a terminal to which a terminal crimping structure according to an aspect of the present invention is applied.

A female terminal (terminal) 10 to which the terminal crimping structure 1 is applied is provided with a receptacle 20 and an conductor grip 30, as illustrated in FIG. 1, and is formed by stamping and forming a metal plate.

Incidentally, the female terminal 10 is connected to a contact carrier C in FIG. 1, but is to be cut off from the contact carrier C after processing.

The receptacle 20, as illustrated in FIG. 1, is formed to have a substantial box shape to receive a male contact (not illustrated) included in the mating connector (not illustrated). A retainer catch 28 to be locked by a retainer (not illustrated), when the female terminal 10 is included in the electrical connector (not illustrated) is provided to protrude upward at a rear end portion, in the front-rear direction, of the upper surface of the receptacle 20 (the direction from the left near side to the right far side of FIG. 1). Hereinafter, the left near side will be referred to as front side, and the right far side will be referred to as rear side.

The conductor grip 30, as illustrated in FIG. 1, is provided with: a conductor barrel 31, which is arranged at the rear side of the receptacle 20 and which crimps the conductor S (refer to FIG. 2) of the covered electrical wire W (refer to FIG. 4), and an insulation grip 32, which is arranged at the rear side of the conductor barrel 31 and which crimps the insulation portion H of the covered electrical wire W.

The conductor barrel 31 includes a pair of crimping side walls 34*a* and 34*b* that open upward. The conductor barrel 31 also includes a crimping portion 31*a* that crimps the conductor S of the covered electrical wire W, and an extension 31*b* that covers the end portion of the conductor S of the covered electrical wire W. Herein, the bottom surface of the conductor barrel 31 is formed to extend as a straight line in the front-rear direction, connecting the crimping portion 31*a* and the extension 31*b*. Also, upper end surfaces of the crimping side walls 34*a* and 34*b* extend in parallel to the bottom surface of the conductor barrel 31 extending in the front-rear direction.

The crimping portion 31*a* swages both of the crimping side walls 34*a* and 34*b*, thereby crimping the conductor S of the covered electrical wire W. In the state where the conductor S of the covered electrical wire W is crimped in the crimping portion 31*a*, desired electrical and mechanical properties are ensured at the crimped part where the crimping portion 31*a* and the conductor S are crimped.

The extension 31 *b* is arranged at the front side of the crimping portion 31 *a*. The extension 31 *b* covers the end portion of the conductor S of the covered electrical wire W by swaging both of the crimping side walls 34*a* and 34*b*. In this case, the extension 31*b* does not crimp the conductor S of the covered electrical wire W. In addition, the extension 31 *b* prevents the end portion of the conductor S from protruding frontward to be exposed from the conductor barrel 31, with the conductor S of the covered electrical wire W crimped to the conductor barrel 31. A confirmation hole 33 is arranged at the crimping portion 31*a* side of the extension 31*b* in the front-rear direction of the crimping side walls 34*a* and 34*b*. The confirmation hole 33 is provided for confirming the position of the end portion of the conductor S in the conductor barrel 31, with the conductor S of the covered electrical wire W crimped to the conductor barrel 31. That is to say, the confirmation hole 33 permits confirming of the position of the end portion of the conductor S of the covered electrical wire W in the conductor barrel 31 from the upper side thereof, with both of the crimping side walls 34*a* and 34*b* of the extension 31 *b* swaged.

The insulation grip 32 opens upward, and includes a pair of insulation side walls 35*a* and 35*b*. The insulation grip 32 crimps the insulation portion H of the covered electrical wire W by swaging both of the insulation side walls 35*a* and 35*b*.

Next, a description will be given of a crimping tool 40 that crimps the covered electrical wire W to the female terminal 10 to form the terminal crimping structure 1.

Figure 2:
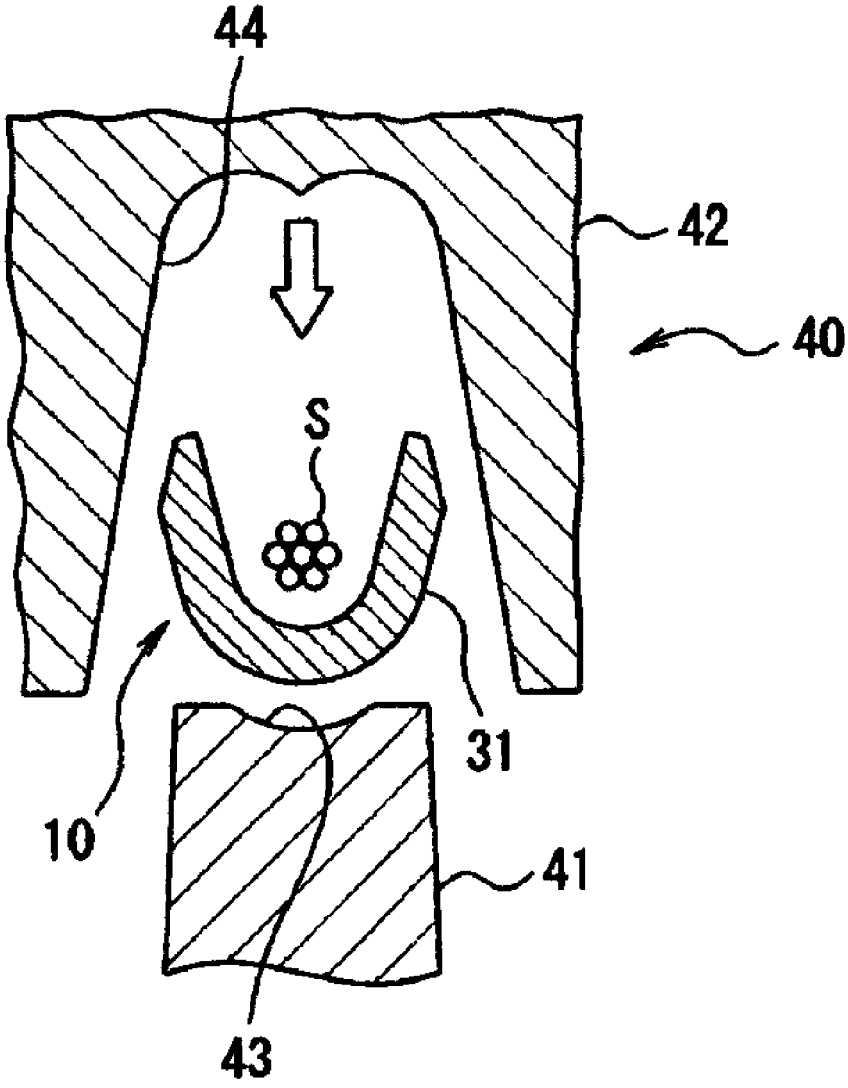
FIG. 2 is a front cross-sectional view of an anvil and a crimper included in a 10 crimping tool according to an aspect of the present invention, and a conductor barrel before a conductor is crimped.
Figure 3:
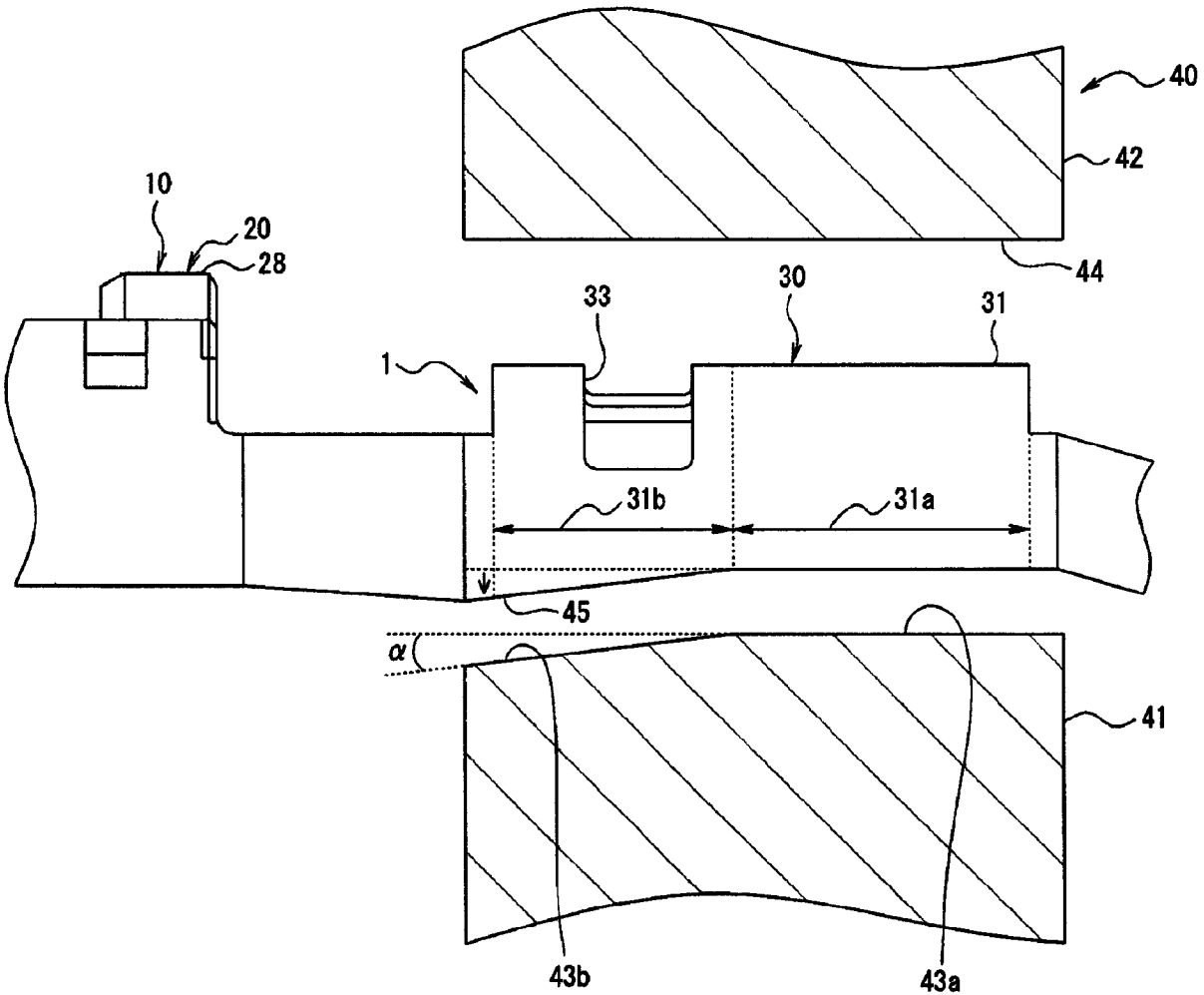
FIG. 3 is a side surface partially cutaway cross-sectional view of the anvil and the crimper included in the crimping tool illustrated in FIG. 2, and the conductor barrel after the conductor is crimped.

The crimping tool 40, as illustrated in FIG. 2 and FIG. 3, is provided with: an anvil 41 on which the female terminal 10 is mounted; and a crimper 42 which presses the conductor barrel 31 of the female terminal 10 mounted on the anvil 41 from the upper side (the upper side of FIG. 2 and FIG. 3).

The upper surface of the anvil 41 is provided with a placement groove 43, as illustrated in FIG. 2, on which the female terminal 10 is mounted and which extends in the front-rear direction (the depth direction of FIG. 2, the horizontal direction of FIG. 3).

The placement groove 43 includes, as illustrated in FIG. 3, a first pressing portion 43*a* that presses the crimping portion 31*a*; and a second pressing portion 43*b* that presses the extension 31 *b*, in the conductor barrel 31 of the female terminal 10 that is mounted.

The bottom surface of the first pressing portion 43*a*, as illustrated in FIG. 3, is formed to extend horizontally, when viewed in the horizontal direction (the horizontal direction of FIG. 2, the depth direction of FIG. 3).

The bottom surface of the second pressing portion 43*b* is formed to be an inclined surface expanding and opening toward the receptacle 20 side when viewed in the horizontal direction, as illustrated in FIG. 3. Herein, it is possible to set an angle a, which is defined by an extension from the bottom surface of the second pressing portion 43*b* and another extension from the bottom surface of the first pressing portion 43*a*, not to exceed 45 degrees. Specifically, the angle is set between 3 to 6 degrees in the embodiment shown.

The crimper 42 is arranged to be movable upward and downward with respect to the anvil 41. The bottom surface of the crimper 42 has a compression groove 44 opposite to the placement groove 43 of the anvil 41 with each other, as illustrated in FIG. 2.

The top surface of the compression groove 44 is formed to extend in parallel to the first pressing portion 43*a* of the placement groove 43 in the anvil 41, when viewed in the horizontal direction, as illustrated in FIG. 3.

Next, a description will be given of an operation of crimping the covered electrical wire W to the female terminal 10 by use of the crimping tool 40 to form the terminal crimping structure 1.

Firstly, as illustrated in FIG. 2, the female terminal 10 is mounted on the placement groove 43 of the anvil 41. In this situation, the crimping portion 31*a* of the conductor barrel 31 is disposed on the first pressing portion 43*a*, and simultaneously the extension 31*b* is disposed on the second pressing portion 43*b*.

Herein, the bottom surface of the conductor barrel 31 is formed to extend as a straight line in the front-rear direction, with connecting the crimping portion 31*a* and the extension 31*b*. On the other hand, the bottom surface of the second pressing portion 43*b* of the placement groove 43 in the anvil 41 is formed to be an inclined surface expanding and opening toward the receptacle 20 side, when viewed in the horizontal direction. Accordingly, when the female terminal 10 is mounted on the placement groove 43 of the anvil 41, the bottom surface of the crimping portion 31*a* and that of the first pressing portion 43*a* are brought into contact with each other, whereas the bottom surface of the extension 31 *b* and that of the second pressing portion 43*b* create a gap there between.

Next, the covered electrical wire W is disposed on the female terminal 10. In this situation, the conductor S of the covered electrical wire W is disposed on the conductor barrel 31, and simultaneously the insulation portion H of the covered electrical wire W is disposed on the insulation grip 32.

Then, the crimper 42 is made to move down as indicated by an arrow in FIG. 2, so that the conductor barrel 31 of the female terminal 10 disposed on the placement groove 43 in the anvil 41 is pressed from the upper side thereof by the crimper 42.

This permits both of the crimping side walls 34*a* and 34*b* of the conductor barrel 31 to be bent along the inner surface of the compression groove 44 of the crimper 42.

In this situation, as described above, the female terminal 10 is mounted on the placement groove 43 of the anvil 41, with the gap created between the bottom surface of the extension 31*b* in the conductor barrel 31 and that of the second pressing portion 43*b* in the placement groove 43. The pressing force, which is produced when the crimper 42 presses the conductor barrel 31 and which is exerted from the anvil 41 to the extension 31 b, is smaller than that exerted from the anvil 41 to the crimping portion 31*a*. Accordingly, as the conductor barrel 31 of the female terminal 10 mounted on the placement groove 43 of the anvil 41 is pressed by the crimper 42 from the upper side thereof, the extension 31 *b* of the conductor barrel 31 is deformed toward the above-described gap side.

Figure 4:
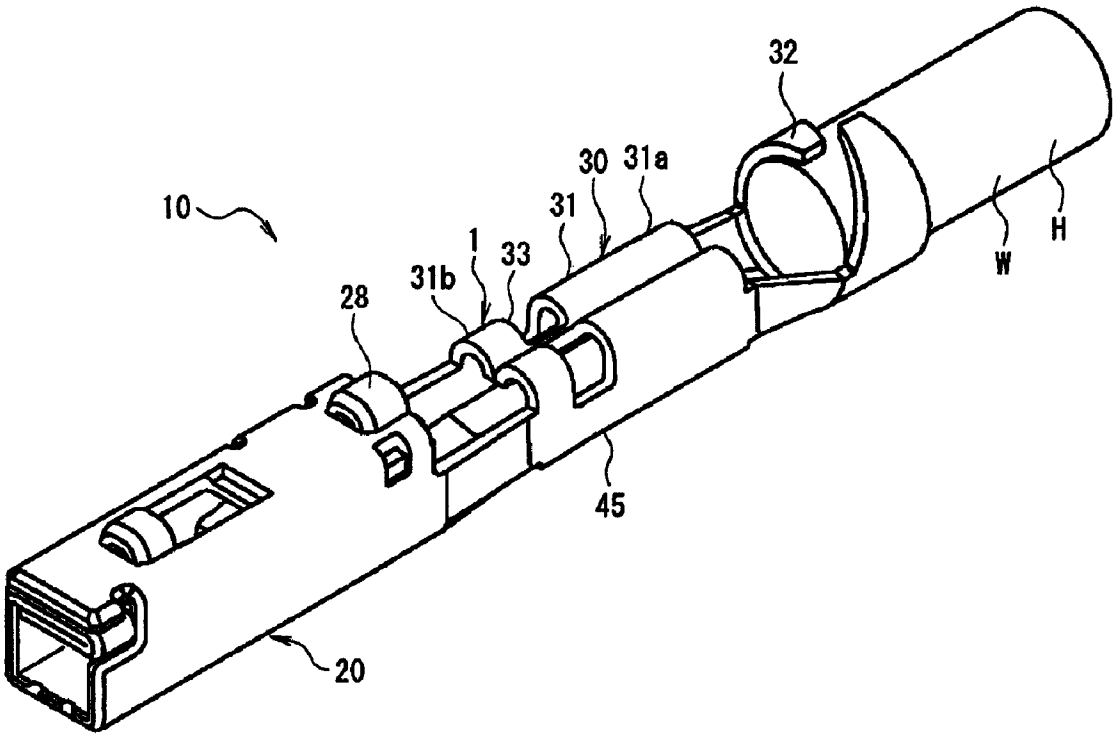
FIG. 4 is a perspective view of a terminal crimping structure according to an aspect of the present invention.

Subsequently, when the crimper 42 reaches the bottom dead center, both of the crimping side walls 34*a* and 34*b*, in the crimping portion 31*a* of the conductor barrel 31, are swaged as illustrated in FIG. 4, so the conductor S of the covered electrical wire W is crimped to the crimping portion 31 *a*. Meanwhile, when the crimper 42 reaches the bottom dead center, both of the crimping side walls 34*a* and 34*b*, in the extension 31 *b* of the conductor barrel 31, are swaged as illustrated in FIG. 3 and FIG. 4. Also, at the same time, the bottom surface of the extension 31*b* is deformed downward along the bottom surface of the second pressing portion 43*b* of the placement groove 43, so an inclined base portion 45 is produced at the lower part of the extension 31 *b*. That is to say, the draft amount of the extension 31 *b* in the conductor barrel 31 is made smaller than that of the crimping portion 31*a*. With this configuration, the conductor S of the covered electrical wire W is not crimped in the extension 31 *b*, but the end portion of the conductor S is covered.

Next, after the crimping of the conductor S of the covered electrical wire W to the conductor barrel 31 is completed, the position of the end portion of the conductor S in the conductor barrel 31 is confirmed from the confirmation hole 33 of the extension 31 *b*. Then, in a case where the end portion of the conductor S is not located on the front side of the rear end portion of the confirmation hole 33, there is a possibility that the conductor S is not crimped over the entire area of the crimping portion 31*a* in the conductor barrel 31, in the inserting/extracting direction (the horizontal direction of FIG. 3). This is judged to be a defective crimp. Conversely, in a case where the end portion of the conductor S is located on the front side of the rear end portion of the confirmation hole 33, it is judged that crimping has been performed in an effective manner.

As described heretofore, the terminal crimping structure 1 illustrated in FIG. 3 and FIG. 4 is formed.

In the manner, in the crimping tool 40, the pressing force exerted from the anvil 41 to the extension 31 *b* is set smaller than that exerted from the anvil 41 to the crimping portion 31*a*. This allows the conductor S of the covered electrical wire W to be crimped only in the crimping portion 31 *a* of the conductor barrel 31, whereas the conductor S is not crimped in the extension 31 *b* because the inclined base portion 45 is formed at the lower part of the extension 31 *b*. Accordingly, the crimping tool 40 makes it possible to suppress the pressing force to be needed for crimping the conductor S of the covered electrical wire W to the conductor barrel 31, and to suppress the reaction force exerted from the conductor barrel 31 to the anvil 41 and the crimper 42. Therefore, the crimping tool 40 makes it possible to limit the abrasion at the anvil 41 and the crimper 42, and simultaneously to prevent the generation of the upthrust portion at the upper part of the conductor barrel 31 to which the conductor S of the covered electrical wire W is crimped.

Figure 5:
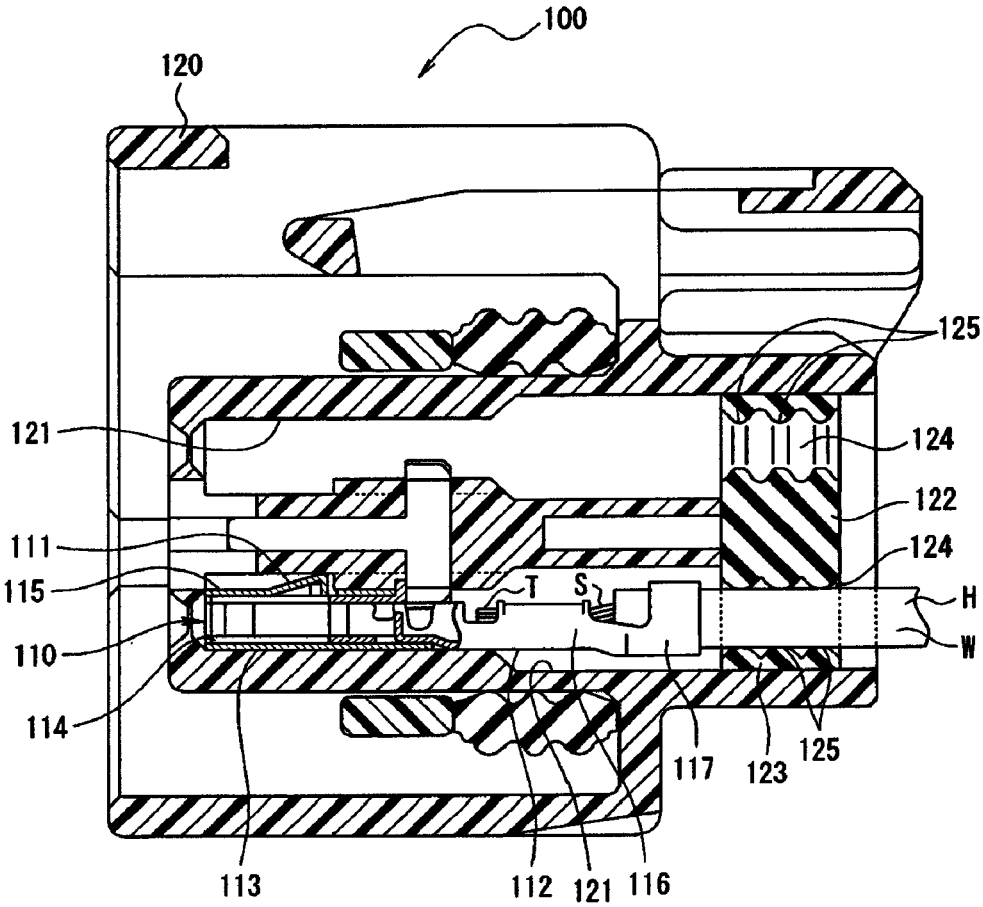
FIG. 5 is a partially cutaway cross-sectional view showing a waterproof connector according to prior art.
Figure 6:
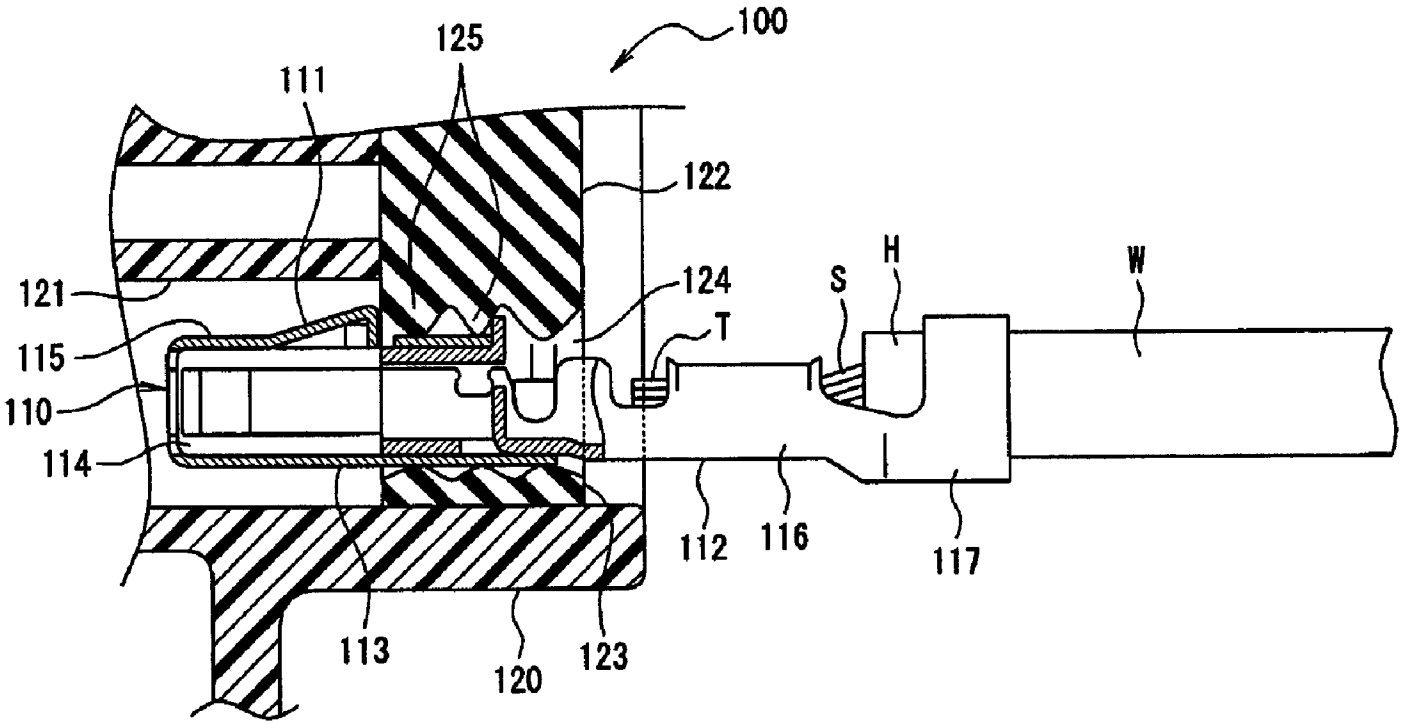
FIG. 6 is a partially cutaway cross-sectional view showing a terminal, which is being inserted into a cavity of the waterproof connector shown in FIG. 5.
Figure 7:
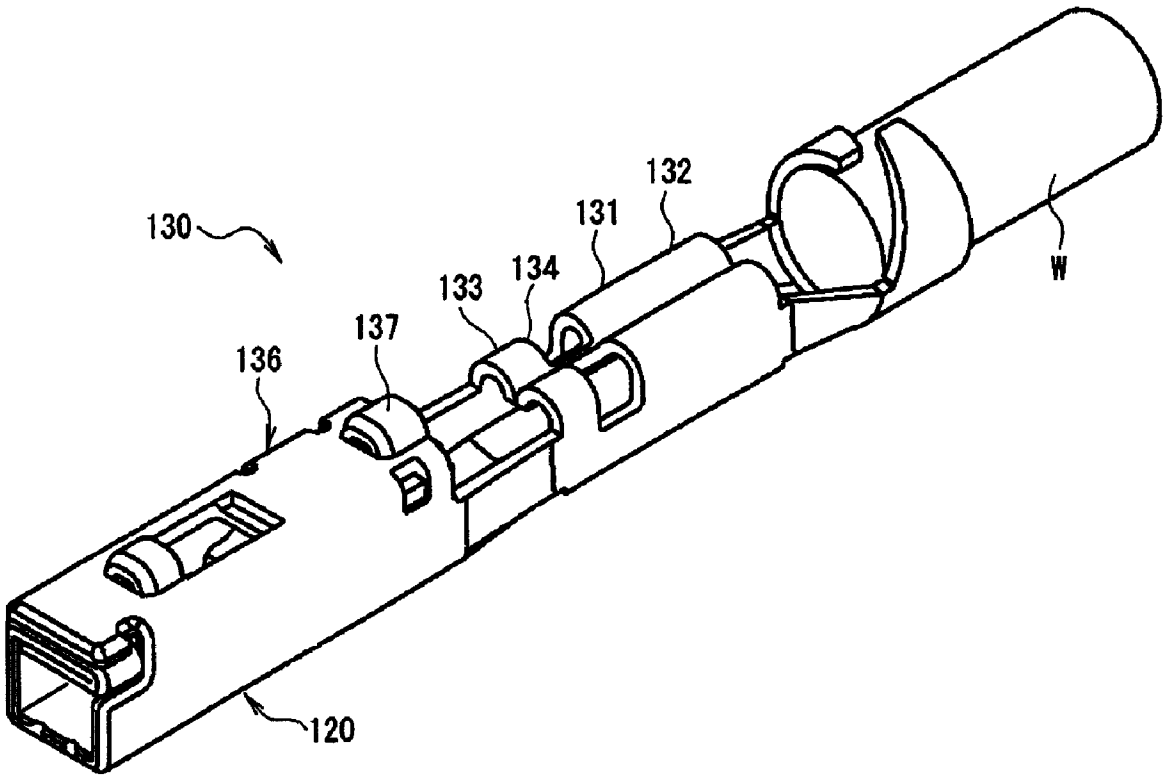
FIG. 7 is a perspective view showing a terminal in which an end portion of a conductor is protected.
Figure 8:
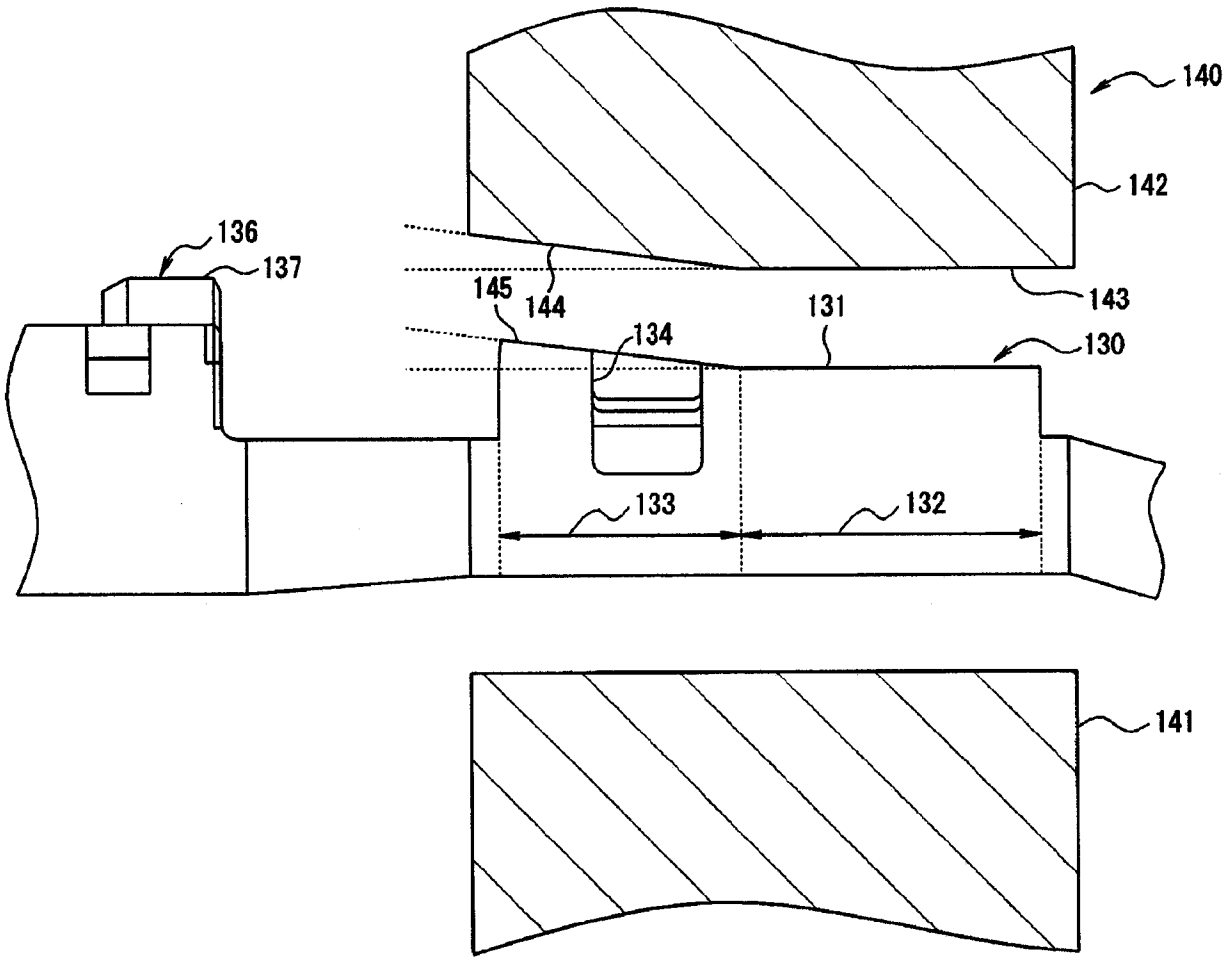
FIG. 8 is a partial cross-sectional view showing the relationship between a conductor barrel of a terminal, and an anvil and a crimper included in the crimping tool.

Additionally, in the terminal crimping structure 1, the extension 31 *b* of the conductor barrel 31 covers the end portion of the conductor S of the electrical wire W, thereby preventing the end portion of the conductor S from extruding frontward to be exposed from the conductor barrel 31. Therefore, with the terminal crimping structure 1, it is possible to prevent the end portion of the conductor S from damaging the sealing member, when the female terminal 10 is inserted into the sealing member included in a connector housing of collective waterproof type such as the connector housing 120 shown in FIG. 5.

Herein, when the female terminal 10 having the terminal crimping structure 1 is included in an electrical connector, the female terminal 10 is secondarily locked by a retainer (not illustrated) to prevent the female terminal 10 from coming off from the connector housing (not illustrated). Then, when the female terminal 10 is locked by the retainer, the female terminal 10 is firstly inserted into the housing with the retainer disposed at a temporary locking position. In this case, the retainer is disposed above the conductor barrel 31 of the female terminal 10 (the upper side of FIG. 3). Then, the retainer disposed at a temporary locking position is made to slide downward (to the lower side of FIG. 3) to be arranged at a proper locking position. In this situation, the front surface of a locking part in the retainer locks the rear surface of the retainer catch 28 of the female terminal 10 to prevent the female terminal 10 from moving rearward. Accordingly, in a state where the retainer is arranged at the proper locking position, a space that corresponds to a sliding amount of the retainer that has been made to slide from the temporary locking position to the proper locking position is inevitably created below the conductor barrel 31 of the female terminal 10. Meanwhile, in the terminal crimping structure 1, the inclined base portion 45 is produced at the lower part of the extension 31*b*. Accordingly, in a case where the female terminal 10 is applied to an electrical connector, the inclined base portion 45 is accommodated in the space inevitably created below the conductor barrel 31. For this reason, the inclined base portion 45 does not interfere with the retainer. Therefore, with the female terminal 10 having the terminal crimping structure 1, it is made possible for the retainer to lock the female terminal 10 with certainty, even when the female terminal 10 is applied to an electrical connector in which the arrangement pitch between the terminals is made small.

Furthermore, in an electrical connector (not illustrated) provided with the female terminal 10 each having the terminal crimping structure 1 and the connector housing (not illustrated) that secures the female terminal 10, the arrangement pitch between the female terminal 10 can be made small.

According to a terminal crimping method or a crimping tool 40, a placement groove 43 of an anvil 41 includes a first pressing portion 43*a* that presses a crimping portion 31 *a* and a second pressing portion 43*b* that presses an extension 31 *b*. The bottom surface of the second pressing portion 43*b* is formed to be an inclined surface expanding and opening toward a receptacle 20 portion side. This lessens the amount of abrasion at the anvil and crimper, and simultaneously prevents the generation of an upthrust portion at the upper part of a wire barrel to which a conductor of a covered electrical wire is crimped.

In addition, a terminal crimping structure 1 according to an aspect of the present invention is configured to produce an inclined base portion 45 at the lower part of the extension 31*b*, thereby allowing a retainer to lock the terminal with certainty, even in a case where the terminal 10 is applied to an electrical connector with a narrow arrangement pitch between the terminals 10.

Furthermore, the electrical connector according to an aspect of the present invention is provided with terminals 10 to which the above terminal crimping structure 1 is applied, whereby the arrangement pitch between the terminals can be made small.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

The invention claimed is:

1. A terminal crimping structure having a terminal comprising:

a receptacle having a retainer catch that protrudes upward; and a conductor barrel that opens upward and has a crimping portion and an extension, the crimping portion adapted to crimp a conductor and the extension positioned at a front of the crimping portion and adapted to cover an end portion of a conductor of a covered electrical wire when the conductor is crimped, wherein inner top surfaces of the crimping portion and the extension extend in a common parallel straight line, while a bottom surface of the extension is deformed downward with respect to the common parallel straight line;

the terminal being mountable on a placement groove, such that the conductor is crimped to the conductor barrel by pressing the conductor barrel with a crimper, the placement groove includes a first pressing portion that presses the crimping portion, a second pressing portion that presses the extension, a bottom surface of the second pressing portion being an inclined surface expanding and opening toward the receptacle side, so an inclined base portion is formed along the bottom surface of the extension.

2. A crimping tool comprising:

an anvil having a mounting surface with a placement groove on which a terminal is mounted, the terminal including a receptacle and a conductor barrel having a crimping portion that crimps a conductor of a covered electric wire and an extension that covers an end portion of the conductor; and a crimper that presses the conductor barrel of the terminal mounted on the anvil, the mounting surface including a first pressing portion that presses the crimping portion and a second pressing portion that presses the extension, the bottom surface of the second pressing portion being formed as an inclined surface expanding and opening toward the receptacle side.

3. An electrical connector comprising:

a terminal crimping structure having a terminal, the terminal having a receptacle with a retainer catch that protrudes upward, an extension positioned at a front of a crimping portion to cover an end portion of a conductor of a covered electrical wire when the conductor is crimped, and a conductor barrel that opens upward, and inner top surfaces of the crimping portion and the extension extend in a common parallel straight line, while a bottom surface of the extension is deformed downward with respect to the common parallel straight line; and a housing that secures the terminal;

wherein the terminal is mountable on a placement groove, such that the conductor is crimped to the conductor barrel by pressing the conductor barrel with a crimper, the placement groove includes a first pressing portion that presses the crimping portion, a second pressing portion that presses the extension, a bottom surface of the second pressing portion being an inclined surface expanding and opening toward the receptacle side, so an inclined base portion is formed along the bottom surface of the extension.

* * * * *